United States Patent [19]

Ardizio

[11] 4,123,096

[45] Oct. 31, 1978

[54] LOCK FOR BIASING DOOR IN CLOSED POSITION

[76] Inventor: Pierre Ardizio, Rue de Saint-Jean 21, 1203-Geneva, Switzerland

[21] Appl. No.: 790,515

[22] Filed: Apr. 25, 1977

[30] Foreign Application Priority Data

Apr. 27, 1976 [CH] Switzerland ..... 5258/76
Apr. 12, 1977 [CH] Switzerland ..... 4490/77

[51] Int. Cl.[2] ..... E05C 3/24
[52] U.S. Cl. ..... 292/216; 292/341.17
[58] Field of Search ..... 292/341.13, 242, 341.17, 292/198

[56] References Cited

U.S. PATENT DOCUMENTS

| | | | |
|---|---|---|---|
| 1,676,515 | 7/1928 | Anstey | 292/341.13 X |
| 1,891,224 | 12/1932 | Edwards | 292/341.13 |
| 2,156,004 | 4/1939 | Vanderlinde | 292/198 X |
| 2,427,134 | 9/1947 | Gronbeck | 292/129 X |
| 3,073,638 | 1/1963 | Chanaryn et al. | 292/226 |

*Primary Examiner*—Richard E. Moore
*Attorney, Agent, or Firm*—Silverman, Cass & Singer, Ltd.

[57] ABSTRACT

A lock including a closing member and a retaining member at least one of which is movable to engage with the other. One of said members being biased into engagement with the other by a return spring to ensure the lock being in the fully closed position.

18 Claims, 13 Drawing Figures

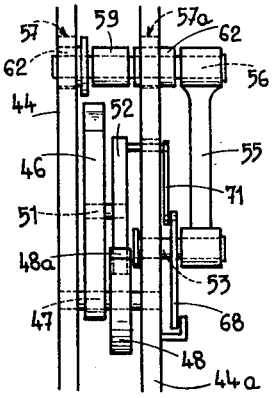
FIG. 9
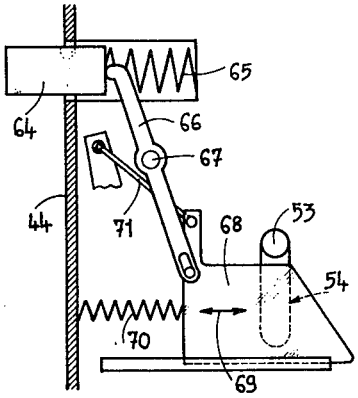
FIG. 10
FIG. 11
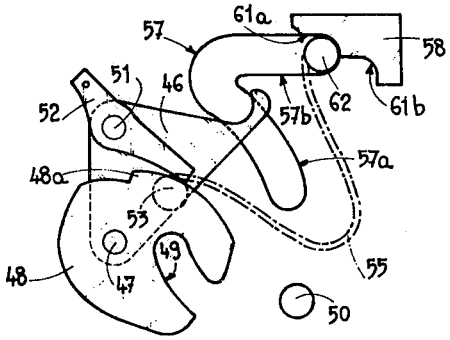
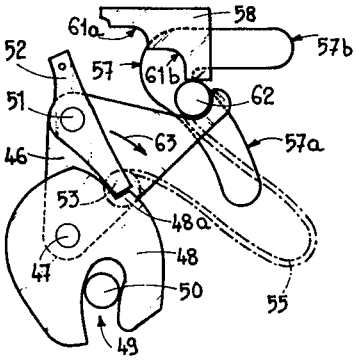
FIG. 12
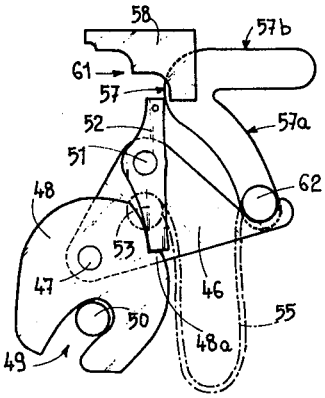
FIG. 13

LOCK FOR BIASING DOOR IN CLOSED POSITION

The present invention relates to a lock comprising two elements hooking to each other, one of which is movable and constitutes a locking member and the other of which constitutes a retaining member, one of these two elements being carried by a stationary frame and the other by a movable leaf.

The locks of this type have the drawback, as well as the conventional locks comprising a bolt engaging a catch, that they do not exert on the leaf any force urging it against the stationary frame, that is to say for completing the closing of the leaf.

In the case of doors of vehicles, submitted to vibrations, this absence of force urging to maintain the door applied against its frame has been corrected by the presence of resilient gaskets, generally of rubber, carried by the door and/or by the frame and which are interposed between these two elements. These gaskets play a double role, on the one hand ensuring the tightness of the closing and, on the other hand serving of return means urging to apply one against the other the two closing elements of the lock, one carried by the door and one carried by the stationary frame.

This solution is however only partially satisfying since it needs a force relatively significant to be developed during the closing of the door, for compressing the said gasket, on the whole periphery of the door, which gasket must, on the other hand, be relatively resistant to play the role of return means the door.

The object of the present invention is to remedy these drawbacks while furnishing, especially but not exclusively for the doors of vehicles, a lock such that not only it maintains the door in its closed position, but exerts on the door a force urging it to be applied against the stationary frame on which it is articulated. The force increases if the door is submitted to an effort urging it to be open.

To this effect, the lock according to the invention is characterized by the fact that one of its elements is submitted to the action of a return spring which urges it against the other element, the arrangement being such that the pressure exerted by the element submitted to the action of the return spring on the other urges the closing of the leaf to be completed.

The drawing shows, by way of example, three embodiments of the object of the invention.

FIG. 9 is a sectional view along line IX—IX of FIG. 8.

FIG. 10 is an elevational view, with partial section, of a detail, and

FIGS. 11, 12 and 13 are elevational views of a part of the lock in three different working positions.

Figure 1:
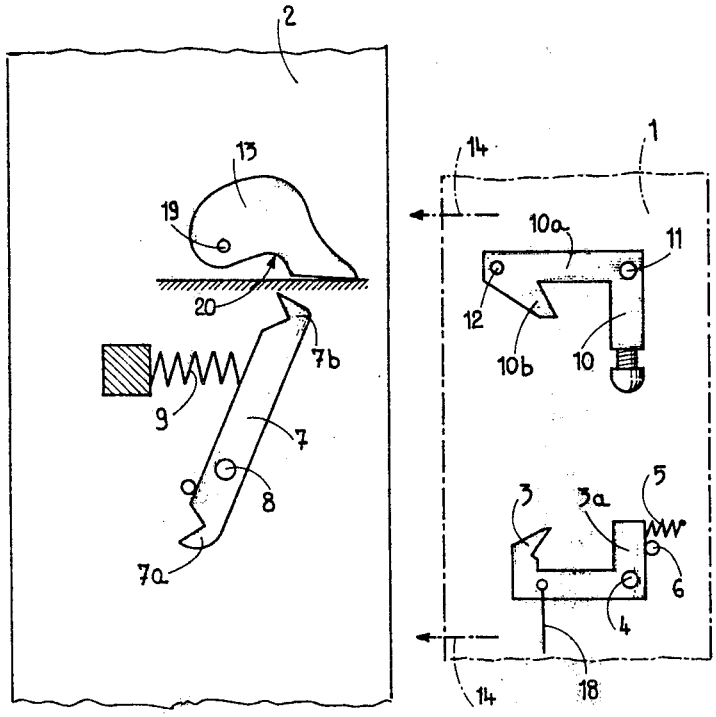
FIG. 1 is a diagrammatic elevational view of a part of a door of a motor-car and of its stationary frame, provided with the present lock, in the opening position of the door.

The lock of motor-car represented in FIG. 1 is designated by 1 and the stationary frame on which it is articulated, which is part of the body of the motor-car, by 2.

The lock comprises a hook 3, constituting a pawl, articulated at 4 on the door 1, which is provided with an arm 3*a* on which acts a return spring 5 urging to maintain this arm 3*a* bearing against a bearing member 6 carried by the door 1.

When the door is closed, the pawl or hook 3 hooks at the lower end 7*a* of a retaining member 7 constituted by a two arms lever articulated at 8 on the stationary frame 2. This retaining member 7 is submitted to the action of a coil spring 9 working to the compression, which urges the said member 7 to rotate in the clockwise direction. It is to be noted that the return spring 9 could be different than a coil spring.

So as to bring the retaining member 7 in a position in which it is able to receive the closing pawl 3, the lock comprises a pushing member 10, articulated at 11 on the door 1, and which is provided with an arm 10*a* provided with a pin 12 on which acts, during the closing of the door, a cam 13 having the shape of a one-pointed hat.

Figure 2:
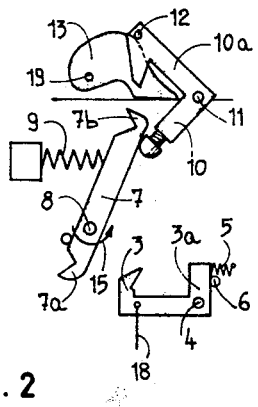
FIGS. 2 to 5 are similar views thereof, at a smaller scale, in four other working positions.

The lock as disclosed and represented operates as follows:

During the closing of the door, this latter moving in the sense of the arrow 14 of FIG. 1, the pushing member 10 acts on the retaining member 7 for rotating it in the sense of the arrow 15 of FIG. 2, against the action of its return spring 9. The antagonist force exerted by this latter is so easy to be surmounted that the member 7 acts as a lever, the point of application of the force exerted by the spring 9 being situated between the axis of articulation 8 and the point where the pushing member 10 is in contact with the member 7. The pushing member 10 is maintained by the cam 13 in a position in which it is able to act on the retaining member 7 (FIG. 2).

Figure 3:
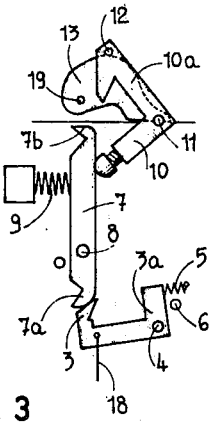

The position occupied by the several elements of the lock just before the closing is represented in FIG. 3.

Figure 4:
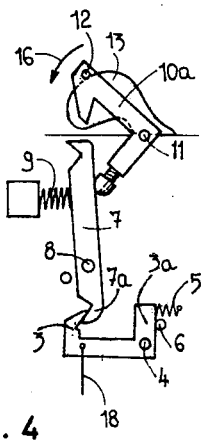

At the moment when the pawl 3 engages the end of the retaining member 7, the pin 12 of the pushing member 10 passes over the apex of the cam 13, that permits the pushing member to fall again, while rotating in the sense of the arrow 16 of FIG. 4, under the effect of its own weight or under the effect of a return spring, not represented, which would urge to rotate it in the counter clockwise direction.

It is to be noted that the end of the arm 10*a* of the pushing member 10 is provided with a hook-shaped portion 10*b* which comes to place itself behind the upper end, designated by 7*b*, of the retaining member 7 and which serves as a safety device preventing any untime opening of the door in the case where the pawl 3 would be untimely separated from the lower end 7*a* of the retaining member 7. In the example disclosed and represented, the hook-shaped part 10*b* is made of one piece with the pushing member 10. However, one could foresee the case where this hook would be secured on the member 10 and would be movably mounted thereon, this hook 10*b* being then submitted to the action of a return spring urging to apply it against the end 7*b* of the retaining member 7.

Figure 5:
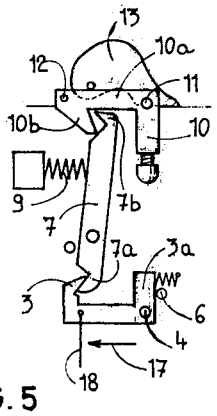

When the lock occupies its closing position, represented in FIG. 5, the return spring 9 of the retaining member 7 acts on the door, by the intermediary of the retaining member and of the pawl 3, for maintaining it in its closing position, exerting thereon a force in the sense of the arrow 17 of FIG. 5, that permits a slight play of the door which can occur when it is matter, as in the example represented, of a door of a motor vehicle the frame of which can be slightly deformed. It is to be noted that a demultiplicating effect is obtained due to the fact that the two parts of the retaining member 7, operating as a lever, are of different lengths.

The return spring 9 has consequently for effect that the gasket interposed between the door 1 and the stationary frame 2, not represented, has practically to play merely a role of tightness and not one of a return means exerting on the door a force preventing any shaking of this latter during the vibrations to which the vehicle is submitted.

Owing to this arrangement, the closing of the door is effected much more easily than with the conventional locks, the force necessary to this effect being a sub-multiple of what it is usually and depending from the ratio of the lever of the retaining member 7 and from the force of the return spring 9.

So that, during the opening of the door which is effected while acting on the pawl 3 by means of a control member 18, the cam 13 be not an obstacle to the passage of the pin 12 of the pushing member 10, the cam is articulated at 19 on the stationary frame 2. It results therefrom that, during the opening of the door, the pin 12 acting on the part of the profile of the cam, indicated by 20 in FIG. 1, lifts the cam which is then eclipsed or released. The cam falls again from itself, by its own weight, into its working position in which it is situated on the trajectory followed by the pin 12 during the closing of the door. The cam 13 could also be submitted to the action of a return spring which would urge it to rotate in the clockwise direction and which would act thereon by the intermediary of the axis of this latter, since the whole periphery of the cam must remain free.

It is to be noted that the lock has been represented in the drawing very diagrammatically and that the shape of its several elements will be determined so that the frictions be reduced to a minimum, the materials being choosen so that the noise be reduced to a minimum too, even if it is not necessary, with the present lock, to slam the door for closing it. Moreover, some elements which have been represented in one piece could be realised in two pieces the relative position of which will be adjustable, so as to permit to effect the adjustments which are necessary for an optimum operation of the lock. At last, nothing prevents to foresee that the elements which have been represented carried by the frame 2 be mounted on the door 1 and that these which are carried by the door be mounted on the frame.

Figure 6:
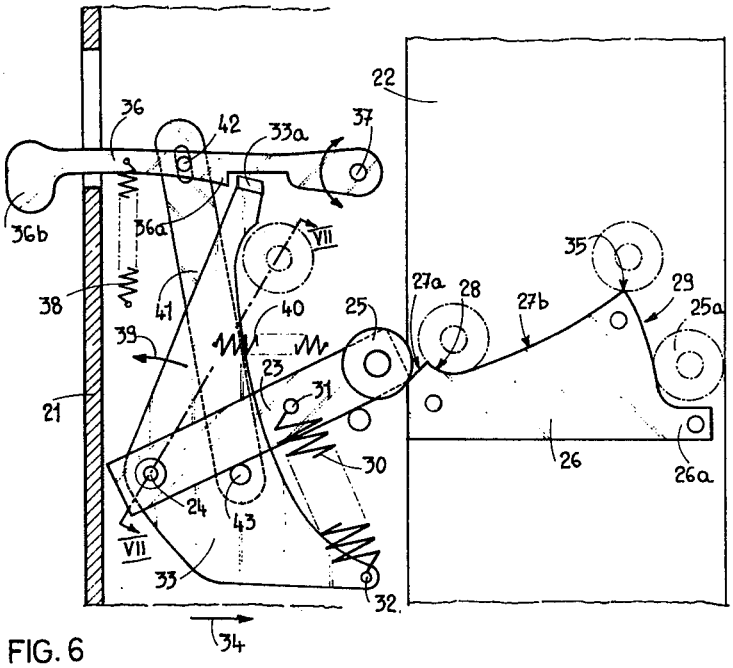
FIG. 6 is an elevational view, with partial section, of a second embodiment of a lock.
Figure 7:
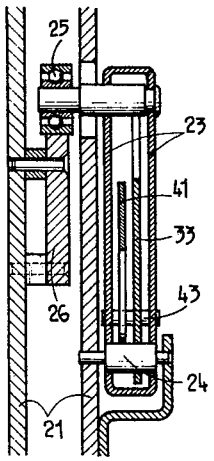
FIG. 7 is a sectional view along line VII—VII of FIG. 6.

The lock represented in FIGS. 6 and 7 comprises a part of its elements carried by a door or leaf 21, and the other by a stationary frame of this door, designated by 22.

This lock comprises a lever 23 articulated at 24 on the door 21, and which is provided, at its free end, with a rolling roller 25. This lever, constituting the closing member of the lock, having the shape of a pawl, cooperates, by its roller 25, represented in dot-and-dash lines in FIG. 6 in several working positions, with a member 26, carried by the frame 22, which is stationary and which plays a double role, this of the retaining member on the one hand and this of the cam acting on the pawl 23–25 on the other hand. To this effect, the member 26 is provided with two ramps provided on its edge, one constituted of two parts **27*a* and 27*b*, separated by a part 28 and which constitutes actually the cam, and the other, designated by 29, which constitutes the retaining means. The lever 23 is submitted to the action of a coil spring 30, working to the traction, hooked on the one hand to the said lever at 31, and, on the other hand, at 32, to a rocking element 33, articulated at 24 on the door 21, coaxially to the lever 23**, and the role of which will be disclosed later.

During the closing of the door 21, which moves then in the sense of the arrow 34 of FIG. 6, the roller 25 rolls first on the first part **27*a* of the first ramp of the member 26, passes over the portion 28 and rolls then on the second part 27*b* of the first ramp for falling against, after having passed over the apex, designated by 35, of the member 26, along the ramp 29** of this latter.

When the door 21 is entirely closed, bearing on the bearing surface of the stationary frame 22, not represented, or on rubber gaskets when it is matter of the door of a motor-car, the roller 25 is not at the end of its run, but occupies the position represented at **25*a* in FIG. 6 where it is situated at a slight distance from an extension 26*a* of the member 26. Hence, the spring 30, while acting on the lever 23, exerts on the door 21, by the intermediary of the roller 25 and of the retaining member 26**, a force urging to complete the closing of the door.

The rocking member 33 to which is hooked the spring 30 is maintained in the position represented, prevented from rotating on itself, by the beak **36*a* of a lever 36 of control of the opening of the door, articulated at 37 on the door 21. This beak 36*a* cooperates with a right angle bent portion 33*a* of the rocking lever 33 for maintaining it in the position represented in FIG. 6 in spite of the force exerted thereon, when the door is closed, by the spring 30**, force which urges the rocking member to rotate in the counter clockwise direction.

When the opening lever 36 is lifted manually, while acting on a head **36*b* with which it is provided to this effect, against the action of a spring 38 which urges it to return downwardly, its beak 36*a* is released from the bent portion 33*a* of the rocking member 33, that releases this rocking member which rotates then in the counter clockwise direction, as indicated by the arrow 39 of FIG. 6, releasing thus the spring 30. The lever 23 is thus released so that the roller 25 can move freely along the ramp 29 and thus can leave the member 26**, that permits the opening of the door.

The rocking member 33 is submitted to the action of a return spring 40 which brings it back into the position represented in FIG. 6 when the door is open, in which position its protrusion **33*a* is hooked to the beak 36*a* of the opening lever 36**, the lock being then ready for a new closing.

So as to prevent to have to exert on the door 21 a strong traction during its opening, so as to oblige the roller 25 to go up along the ramp 29 of the retaining member 26, the lock comprises still a small link 41 articulated, at 42, with play, on the opening lever 36, and which carries, at its opposed end, a pin 43 engaged under the lever 23. When the opening lever 36 is operated, and owing to the play of its connection with the small link 41, it moves first freely, releasing thus the rocking member 33, then, the spring 30 being released, the continuation of the displacement of the lever 36 upwardly drives upwardly the small link 41 the pin 43 of which lifts the lever 23. Hence, the roller 25 passes easily over the ramp 29 of the retaining member 26 without on the door a substantial traction.

The fact that the first ramp of the part constituting the cam of the member 26 is in two portions **27*a* and 27*b*, separated by the element 28, has for effect that the closing of the door is now and henceforth ensured as soon as the roller 25 has passed over the ramp 27***a* and has reached the said element 28, that constitutes a safety element for the closing.

In the embodiment of FIGS. 8 to 13, the door or leaf is designated by 44 and the stationary frame by 45. The door is provided with a lever 46, articulated thereon at 47, coaxially to a rotatable disc 48 provided with a notch 49 intended to be hooked to a pin 50, constituting the retaining member, secured to the frame 45. The lever 46 carries moreover, for reasons which will be indicated later, articulated thereon at 51, a two arms lever 52, constituting a pawl, intended to be hooked to a beak 48*a* of the notched disc 48, so as to render it rigid, in rotation, with the lever 46. This lever 52 is submitted to the action of a return spring, not represented, for instance a wire spring, acting on its axis of articulation 51, which urges it to be applied against the disc 48.

The door 44 is provided, secured thereon by one of its ends by means of a pin 53 engaged in an elongated aperture 54 of the door, with a blade-spring 55, elbowed, the opposed end of which carries a pin 56 engaged in two V-shaped notches 57 provided, respectively, in the door 44 and in an inner wall 44*a* of the door. One of the arms, 57*a*, of the said notch 57 has the shape of an arc of circle and has its center which coincides with the axis of articulation 47 of the lever 46 on the door.

The frame 45 carries a member 58, having the shape of a cam, intended to cooperate with a roller 59 (FIG. 9) rotatably mounted on the pin 56 carried by the upper end of the spring 55.

Figure 8:
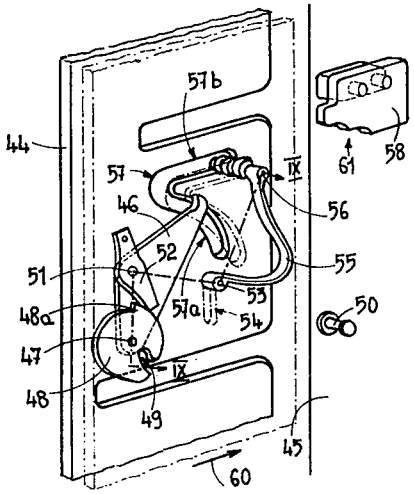
FIG. 8 is a perspective view of a part of a third embodiment of a lock.

Upon the closing of the door, during which this latter is moved in the sense of the arrow 60 of FIG. 8, the roller 59 encounters a first portion 61*a* of a double recess 61 of the cam-shaped member 58, that urges the pin 56 to move along the rectilinear portion, designated by 57*b*, of each of the notches 57, thus winding the blade-spring 55. It is to be noted that the pin 56 carries two rollers 62 (FIG. 9) engaged in the two notches 57. As the closure of the door is continuing, the cam 58 acts on the spring 55 by means of a second portion, 61*b*, of the recess 61, until it brings each roller 62 to pass over the apex of the V-shaped notches 57. The spring 55 is then pinched to the maximum, as shown by FIG. 12. The pin 56; carrying the rollers 62 is then urged to move over the apex of the V-shaped notch 57, this pin tends to move from itself, on the effect of the resilient force of the spring 55, in the arc of circle-shaped part 57*a* of each of the notches 57, in a movement during which its roller 59 encounters the end of the latter 46, that makes this lever to rock in the clockwise direction, as indicated by the arrow 63 of FIG. 12.

Simultaneously, the notch 49 of the disc 48 has capped the retaining pin 50 (FIG. 11). The pressure exerted by the pin 50 on the disc 48 has rotated this disc on itself in the clockwise direction, bringing the pawl 52 to be hooked behind the beak 48*a* of the disc 48. The rotation of the lever 46 under the effect of the spring 55 affords the locking of the disc 48 on the pin 50. Moreover, in the closing position represented in FIG. 13, the rollers 62 are not at the end of their run at the end of the portion 57*a* of each notch 57, so that the spring 55 exerts on the door 44, by the intermediary of the lever 46 and of the disc 48 bearing on the pin 50, a force tending to complete the closing of the door.

The opening of the door is effected by means of a push-button 64 (FIG. 10) carried by the door 44, submitted to the action of a return spring 65 which acts, by the intermediary of a two arms lever 66 articulated at 67 on the door, on a retaining member 68 mounted on the door 44 so as to be able to move itself along the direction of the arrow 69, in a sliding movement. This member 68 is submitted to the action of a spring 70 which urges it to return towards the right of FIG. 10 into the position represented in this figure. In this position, this member 68 blocks the elongated aperture 54 in which is engaged the pin 53 of the spring 55, maintaining this pin at the upper end of the opening 54.

When a pressure is exerted on the pusher 64, the member 68 is moved towards the left side of FIG. 10 by the lever 66, against the action of its return spring 70, releasing the pin 53 of the spring 55. This pin 53 moves then in the opening 54, that releases the spring 55 and thus releases the closing lever 46. Simultaneously, the pawl 52 is released from the beak 48*a* of the disc 48 owing to a connecting rod 71 connecting the member 68 to the said pawl. Hence, the disc 48 is freely released from the retaining pin 50, that permits the opening of the door.

What I claim is:

1. A lock including at least two elements adapted to be hooked together, at least one element being movable and acting as a closing member, a second element acting as a retaining member, one of said elements mounted on a stationary frame and the other on a movable leaf, said lock comprising:

said closing member including an articulated hook operating as a pawl for hooking itself to said retaining member;

said retaining member including a lever articulated on a support and biased in a return direction by a return spring;

said hook mounted on a second support, said second support including a pushing member articulated thereon, said pushing member during the closing of said leaf acting against said retaining member opposite the return direction of said return spring to engage said retaining member on said pawl; and release means to release said pushing member when said leaf is approximately in the closed position, the release of said pushing member releasing said retaining member which is then urged into the fully closed position by said return spring.

2. The lock as claimed in claim 1 wherein:

said retaining member lever includes two arms, said pawl acting on the end of a first one of said arms and said pushing member acting on the second one of said arms.

3. The lock as claimed in claim 1 wherein:

said release means includes a cam mounted on said retaining member support in a first position, said cam including a surface which lifts said pushing member as said pushing member acts against said retaining member which surface terminates to release said pushing member when it is substantially in the closed position which then releases said retaining member.

4. The lock as claimed in claim 3 wherein:

said cam is articulated on said retaining member support to be released from said first position during the opening of said leaf to permit the passage of said pushing member, said cam returning to said first position after the passage of said pushing member so that its surface will again act to lift said pushing member during the next closing of said leaf.

5. The lock as claimed in claim 3 wherein:

said cam has a profile shape of a one-pointed hat biased to said first position by a return spring acting thereon, said return spring acting on the axis of articulation of said cam such that the periphery of said cam is unobstructed; and said pushing member including a protrusion extending therefrom which acts upon said cam surface.

6. The lock as claimed in claim 4 wherein:

said pushing member includes a first hook shaped portion, said cam surface termination being located such that when said pushing member is released said hook portion will engage said second arm of said retaining member to ensure that the lock is not released if said closing member is accidentally disengaged from said first arm of said retaining member.

7. The lock as claimed in claim 4 wherein:

said closing member and said pushing member are both carried by said leaf; and said retaining member and said cam are both carried by said stationary frame.

8. A lock including at least two elements adapted to be hooked together, at least one element being movable and acting as a closing member, a second element acting as a retaining member, one of said elements mounted on a stationary frame and the other on a movable leaf, said lock comprising:

a cam mounted on the same frame or leaf as said retaining member, said cam acting on said closing member when said leaf is being closed to apply it against said retaining member;

said retaining member formed integrally with said cam, said retaining member including at least a first and second ramp, said first ramp providing the cam surface of said cam and said second ramp providing the retaining means of said retaining member, said closing member including a pawl which engages with said ramps during the closing of said leaf, said pawl including a return spring biasing said pawl against said ramps, said first ramp lifting said pawl against said spring as it slides thereover, said second ramp allowing said pawl to be returned toward said spring while engaged on said second ramp, said force exerted between said pawl and said second ramp urging the leaf into the fully closed position;

said return spring engaged at one end on said pawl and at the other end on a rocking member articulated on the same support, said rocking member maintained in its working position by an opening lever, said opening lever articulated on said support, said opening lever releasing said rocking member when it is moved to the open position, said rocking member moving to a rest position to remove the tension from said return spring which releases said pawl to permit the opening of the leaf, said pawl sliding freely on said second ramp to said first ramp to release said closing member from said retaining member.

9. The lock as claimed in claim 8 wherein:

said rocking member includes a return spring biasing it into said rest position in which the tension of said pawl return spring is released.

10. The lock as claimed in claim 9 wherein:

said opening lever includes a spring biasing said lever against said rocking member to maintain said rocking member in said working position against the action of said pawl return spring.

11. The lock as claimed in claim 8 wherein:

said opening lever is connected to said pawl with some play therebetween by a link, said link coupled to said opening lever such that when said lever is in the fully opened position, said link lifts said pawl released by said pawl spring to facilitate the release of said pawl from said retaining member.

12. The lock as claimed in claim 8 wherein:

said pawl includes an articulated lever carrying on one end a roller, said roller engaging said first and second ramps of said cam and said retaining member.

13. A lock including at least two elements adapted to be hooked together, at least one element being movable and acting as a closing member, a second element acting as a retaining member, one of said elements mounted on a stationary frame and the other on a movable leaf, said lock comprising:

a cam mounted on the same frame or leaf as said retaining member, said cam acting on said closing member when said leaf is closed to apply it against said retaining member;

a spring including a free end rigid with a guiding member, said cam engaging against said guiding member to move said guiding member in a notch provided in the support of said spring, such that during the closing of said leaf said free end of said spring moves in said notch to a point in said notch where said spring free end will move away from said cam in said notch under the force of the spring to engage against said closing member to apply it against said retaining member.

14. The lock as claimed in claim 13 wherein:

said spring bears by its second end on a movable element, said movable element movable by an opening member, the movement of said movable element releasing said spring which releases said closing member which may then be removed from said retaining member.

15. The lock as claimed in claim 13 wherein:

said closing member includes a lever which is acted on by said free end of said spring, which lever cooperates with said retaining member.

16. The lock as claimed in claim 15 wherein:

said retaining member includes an upstanding pin; and said lever includes a disc rotatably mounted thereon having a notch in said disc, said notch being hooked on said pin during the closing of said leaf.

17. The lock as claimed in claim 16 wherein:

said lever further includes a pawl mounted thereon to engage with said disc to prevent said disc from rotating on itself when it is hooked on said retaining member pin to lock said members together.

18. The lock as claimed in claim 17 wherein:

said movable element on which said opposed end of said spring bears is arranged such that when it is moved by said opening member, said movable element releases said pawl from said disc so that said disc may rotate releasing the notch from said retaining member pin.

* * * * *